US010487628B2

(12) United States Patent
Hern et al.

(10) Patent No.: US 10,487,628 B2
(45) Date of Patent: Nov. 26, 2019

(54) ONE TRIP DRILL AND CASING SCRAPE METHOD AND APPARATUS

(71) Applicant: Baker Hughes, a GE company, LLC, Houston, TX (US)

(72) Inventors: Gregory L. Hern, Porter, TX (US); Yang Xu, Houston, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 0 days.

(21) Appl. No.: 16/049,171

(22) Filed: Jul. 30, 2018

(65) Prior Publication Data

US 2018/0334886 A1 Nov. 22, 2018

Related U.S. Application Data

(62) Division of application No. 13/951,230, filed on Jul. 25, 2013, now Pat. No. 10,041,333.

(51) Int. Cl.
*E21B 37/02* (2006.01)

(52) U.S. Cl.
CPC ..... *E21B 37/02* (2013.01)

(58) Field of Classification Search
CPC ..... E21B 37/02; E21B 37/04; E21B 37/08; E21B 37/045; E21B 17/006; E21B 12/06
See application file for complete search history.

(56) References Cited

U.S. PATENT DOCUMENTS 7,628,213 B2 12/2009 Telfer
7,954,555 B2 6/2011 Ashy et al.
2002/0005284 A1* 1/2002 Allen ..... E21B 37/02 166/173
2005/0028982 A1 2/2005 Howlett et al.
2005/0241856 A1* 11/2005 Lassoie ..... E21B 10/322 175/57
2006/0219441 A1* 10/2006 Telfer ..... E21B 17/1078 175/325.7
2008/0093080 A1 4/2008 Palmer et al.
2008/0128169 A1* 6/2008 Radford ..... E21B 10/322 175/57
2009/0025927 A1* 1/2009 Telfer ..... E21B 21/103 166/174
2010/0096122 A1 4/2010 Posevina et al.
2010/0126718 A1 5/2010 Lilley
2010/0243257 A1 9/2010 Krieg et al.
2011/0073371 A1* 3/2011 Radford ..... E21B 10/322 175/57
2011/0155465 A1* 6/2011 Allamon ..... E21B 10/322 175/57

(Continued)

*Primary Examiner* — David Carroll
(74) *Attorney, Agent, or Firm* — Shawn Hunter

(57) ABSTRACT

A drilling assembly is tripped in a cased hole to make more open hole. The assembly features retracted scrapers and a closed circulation sub so that the drilling can commence with string pressure delivered to bit nozzles due to the circulation sub being in a closed position. When drilling is done and the bit is to be removed, an object lands on a seat on a sleeve that acts as a piston to break scraper retainers for casing scraping deployment and to open the circulation port. A bypass opens around the seated ball when the sleeve shifts to allow flow around the seated ball for circulation while scraping. Drilling and casing scraping are accomplished in a single trip.

12 Claims, 4 Drawing Sheets

(56) References Cited

U.S. PATENT DOCUMENTS

| | | | | |
|---|---|---|---|---|
| 2011/0186355 | A1* | 8/2011 | Telfer | E21B 37/02 175/57 |
| 2011/0265988 | A1 | 11/2011 | Hern et al. | |
| 2012/0085548 | A1* | 4/2012 | Fleckenstein | E21B 34/063 166/373 |
| 2015/0090494 | A1* | 4/2015 | Lazarev | E21B 47/122 175/40 |

* cited by examiner

ONE TRIP DRILL AND CASING SCRAPE METHOD AND APPARATUS

CROSS REFERENCE TO RELATED APPLICATION

This application is a divisional application and claims priority to U.S. application Ser. No. 13/951,230 filed on Jul. 25, 2013, which is incorporated by reference herein in its entirety.

FIELD OF THE INVENTION

The field of the invention is a method for drilling and casing scraping in a single trip that can also involve circulation to scrapers or/and the bit and related apparatus to enable the method.

BACKGROUND OF THE INVENTION

Rig time when making or extending a hole is a major cost item in creating a producing well and for that reason optimizing procedures to reduce the number of trips in the hole is the focus of constant efforts by operators and service companies. In situations where the well is being extended beyond casing that has earlier been run and cemented, there occur situations depending on the properties of the drilling mud or the formation where the making of more hole with a drill bit at the end of a drill string beyond the end of the casing results in undesirable deposits on the existing casing. It is advantageous to remove such deposits for many reasons not least of which is to allow smooth and rapid entry of other tools or strings through the casing without getting hung up or stuck. In the past the drill string assembly was pulled out of the hole (POOH) and a separate trip was run with scraping equipment.

Generally the scraping equipment was retained in a retracted position with one set of springs and when the desired start point for scraping was reached a different set of springs was released to allow the scrapers to extend into scraping position. These designs went in without rotation and were generally considered ill-suited for the present invention of a one trip method of drilling and scraping a casing on pulling out of the hole. Accordingly, the apparatus that supports the method has incorporated a retention and release system for the scrapers that integrates operation of a ported sub to enable circulation when scraping to enhance the removal capabilities. In several alternatives the circulation can be optional or can be directed in tandem to the annulus and some to the bit still in the hole or entirely to the annulus near the scrapers and bypassing the drill bit altogether.

Relevant background art to the present invention as claimed in the claims is a circulation sub that has two sleeves that allows sequential operation of two movements to allow opening and then closing a port in a ported sub. This design is described in U.S. Pat. No. 7,954,555. US 2010/0243257 shows a releasable scraper. Scrapers are generally described in US 20100096122 and US 20110265988.

The present invention is focused on a one trip method to drill and then scrape as the bit comes out of the hole as well as devices that make the method possible. In one variation the scraper and stabilizers are part of the drill string that can further optionally include a closed ported sub so that circulation for drilling goes through the drill bit. When drilling is done and the bit is POOH the drill string receives an object to allow powering a piston that releases the scrapers. The object is then allowed to pass further to a circulation sub to open a circulation port so that circulation with scraping can go on as the drill bit is removed. Shifting the piston passes the object further downhole for operation of the circulation sub to the open position. High circulation rates can be achieved and the configuration can allow some flow to go to the bit or to bypass the bit completely. In a preferred alternative a single sleeve releases the scrapers which are retained externally to a mandrel with stabilizers. Sleeve shifting shears retainers and opens circulation ports. A bypass for the dropped ball landed on the seat of the sleeve piston also opens on shifting of the sleeve to enable circulation flow that bypasses the blocking object. These and other aspects of the present invention will be more readily apparent to those skilled in the art from a review of the description of the preferred embodiment and the associated drawings while recognizing that the full scope of the invention is to be determined from the appended claims.

SUMMARY OF THE INVENTION

A drilling assembly is tripped in a cased hole to make more open hole. The assembly features retracted scrapers and a closed circulation sub so that the drilling can commence with string pressure delivered to bit nozzles due to the circulation sub being in a closed position. When drilling is done and the bit is to be removed, an object lands on a seat on a sleeve that acts as a piston to break scraper retainers for casing scraping deployment and to open the circulation port. A bypass opens around the seated ball when the sleeve shifts to allow flow around the seated ball for circulation while scraping. Drilling and casing scraping are accomplished in a single trip.

BRIEF DESCRIPTION OF THE DRAWINGS

FIG. 1 is the preferred embodiment shown in section during running in;

FIG. 6 is a ported sub that can be run below the FIG. 5 scrapers to provide a circulation port when scraping and shown in the closed position for run in;

DETAILED DESCRIPTION OF THE PREFERRED EMBODIMENT

Figure 1:
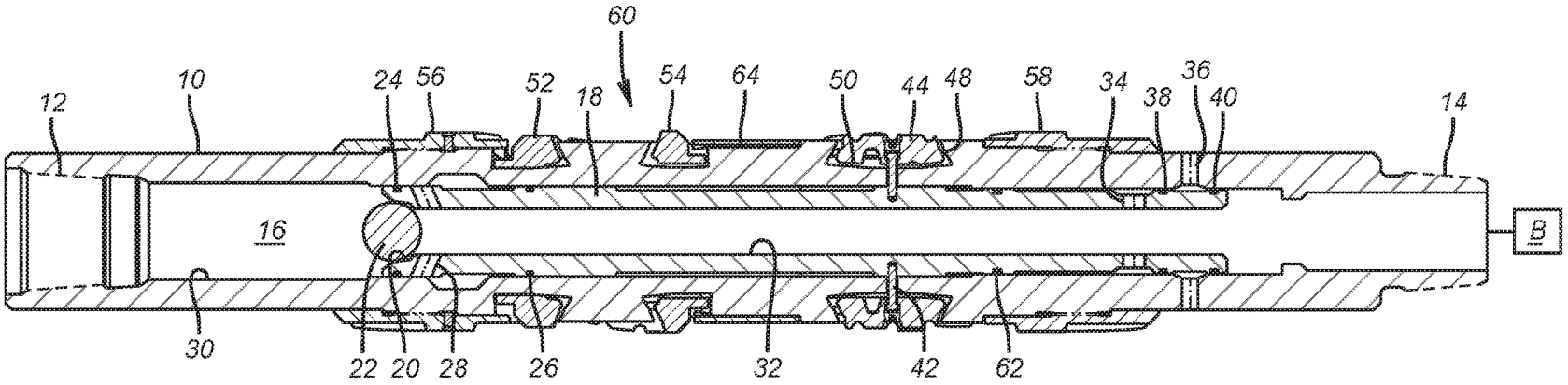

FIG. 1 shows a mandrel 10 supported at thread 12 by a drill string that is not shown. The bit B is schematically illustrated as attached to the thread 14 at the lower end. The bit B is intended to include not only the bit itself but other well-known tools associated with bits such as instruments, measurement while drilling and steering devices to mention a few. Passage 16 extends through the mandrel 10 to allow flow to reach the bit B during drilling and return to the surface in the customary way.

Figure 4:
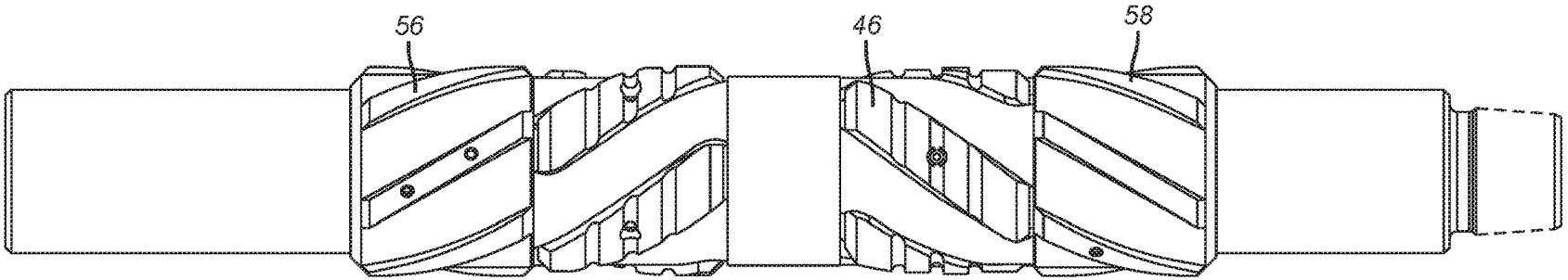
FIG. 4 is an exterior view of an alternative embodiment showing the scrapers and stabilizers.

A sleeve 18 has a ball seat 20 to selectively receive ball 22. Seals 24 and 26 isolate bypass passage 28 when in contact with the inner wall 30 of the mandrel 10. Passage 16 continues as passage 32 inside the sleeve 18. Sleeve 18 has ports 34 that are initially misaligned with ports 36 and further isolated from each other with seals 38 and 40 that are preferably mounted to the sleeve 18. In the FIG. 1 position the flow is through passages 16 and 32 to the bit B and the ball 22 is not in position. Ball 22 is dropped to use pressure to shift sleeve 18 to break shear pins such as 42 that retain a lower scraper assembly 44. FIG. 4 shows the exterior view of the scraper elements 46 that are spirally wound to radially extend from spiral openings such as 48 so that radial extension is limited when the spring bias 50 is allowed to push radially outwardly as the shear pins 42 are sheared by sliding of the sleeve 18. There is illustrated an upper scraper assembly that have the same spirally wound elements as the lower scraper assembly with FIG. 1 showing in section the opposed ends 52 and 54 of adjacent scraper elements seen in the illustrated section view. Stabilizers 56 and 58, which are better seen in FIG. 4 flank the lower scraper assembly 44 and the upper scraper assembly 60. The stabilizers can axially overlap the scraper assemblies 44 and 60 to act as radial travel stops when the scraper assemblies are released due to shearing of shear pins such as 42 by sliding of sleeve 18. Seal 62 can be optionally used for backup to the other seals. Sleeve 64 also acts as a radial travel limit for the scraper assemblies 44 and 60 and is disposed between them.

Figure 2:
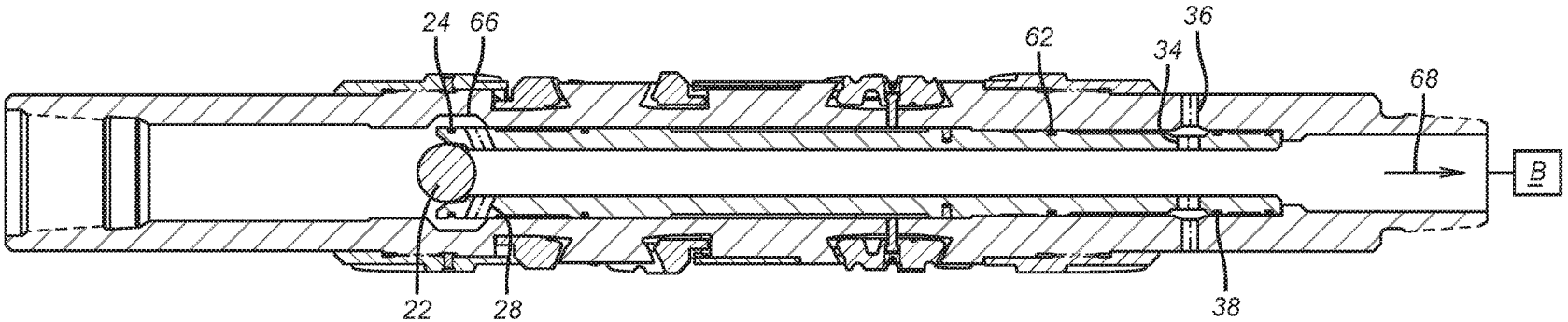
FIG. 2 is the view of FIG. 1 shown in the operating position.
Figure 3:
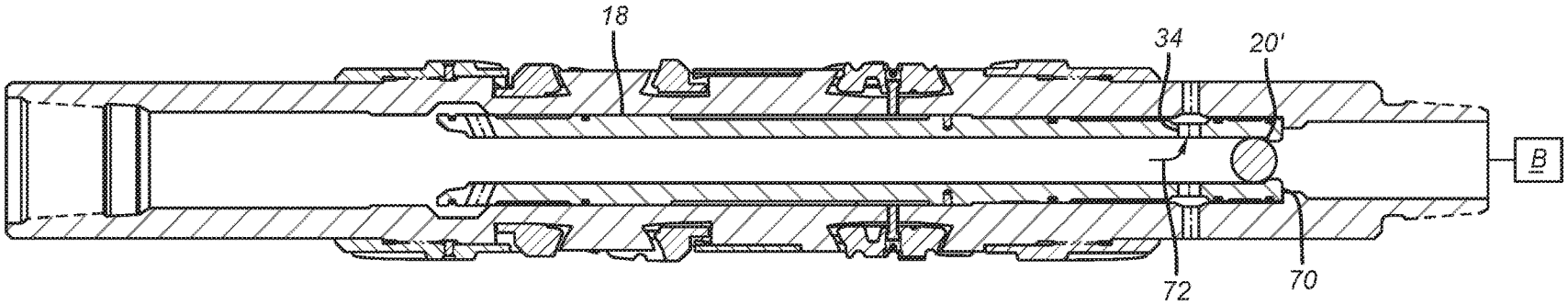
FIG. 3 is a variation of FIG. 2 showing the ball seat below the circulation port to isolate a drill bit when circulating.

FIG. 2 illustrates the landed ball 22 on the shifted sleeve 18 so that seal 24 aligns with groove 66 so that flow is able to go past seated ball 22 through passages 28 and out through the now aligned ports 34 and 36 that are now straddled by seals 38 and 62. Arrow 68 indicates that some flow in the FIG. 2 configuration goes down to the bit B to keep some uphole circulation past the tools and instruments associated with the bit B in the event some of the formation in open hole sloughs off the wall and into the borehole during the scraping operation. As an alternative, FIG. 3 shows the seat 20' located at the lower end 70 of sleeve 18 and below ports 34. In this situation all the flow exits aligned ports 34 and 36 as indicated by arrow 72.

Figure 5:
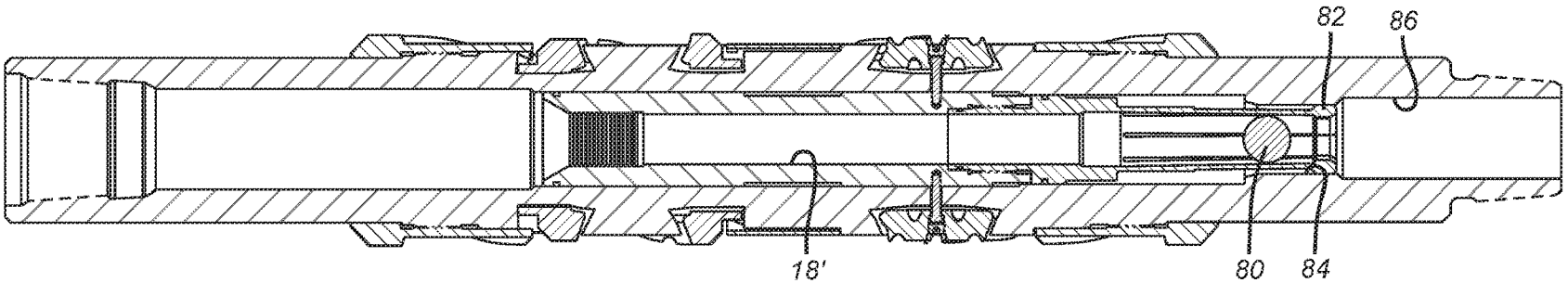
FIG. 5 is the view of FIG. 4 shown in section with the first ball landed on a collet seat and ready to shift to release the scrapers.
Figure 6:
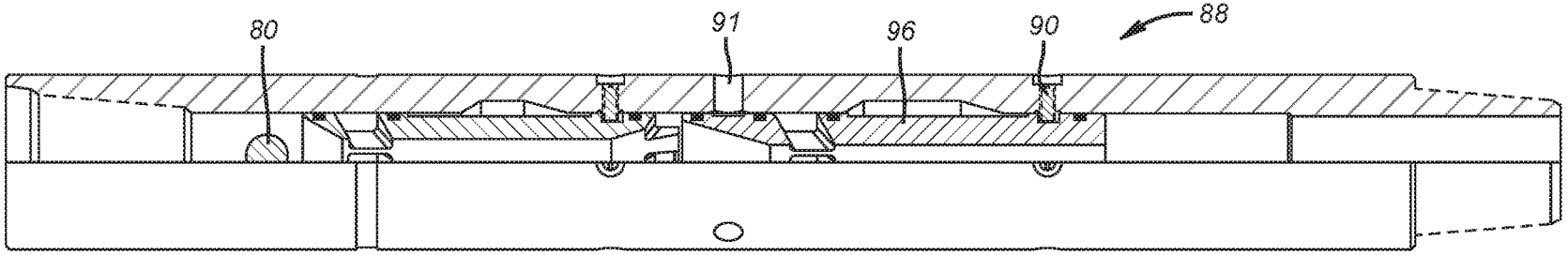
Figure 7:
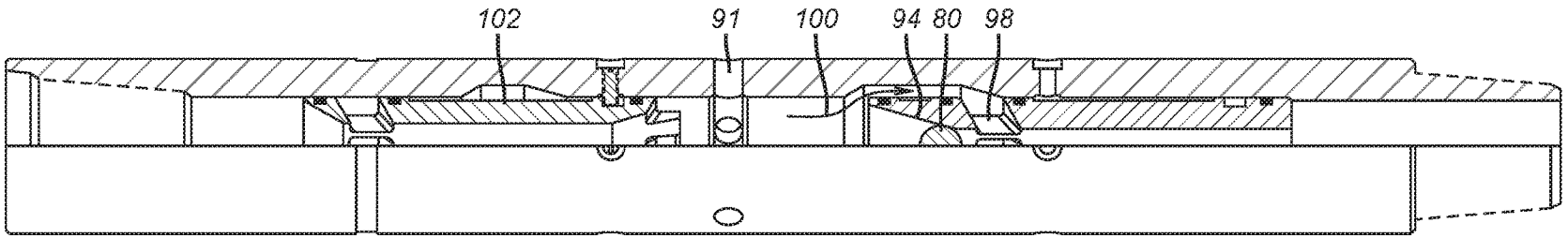
FIG. 7 is the view of FIG. 6 with a ball landed on a seat and the sleeve shifted to open the circulation ports.
Figure 8:
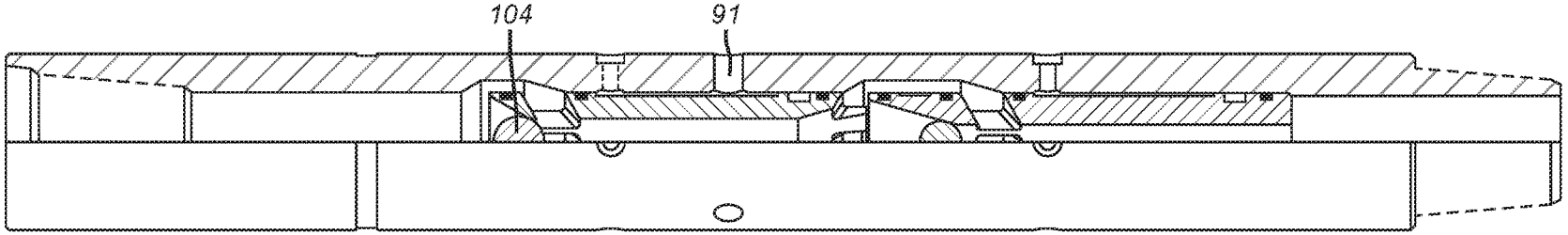
FIG. 8 is the view of FIG. 7 with the ports closed with a second object shifting a second sleeve.

FIGS. 4 and 5 are slightly different than FIGS. 1-3 described above. The sleeve 18' is moved by landing a first ball 80 on an array of collet heads 82 that are initially located in reduced bore 84. Building up pressure on seated ball 80 shifts the sleeve 18' and moves the collet heads 82 to a bigger adjacent bore 86 that that allows the ball 80 to drop and pass into the ported sub 88 that is below that is shown in FIG. 6 to then open the ported sub 88 at ports 91. Ball 80 lands on seat 94 and with applied pressure breaks shear pin 90 to misalign sleeve 96 with ports 91 as shown in FIG. 7. Bypass passage 98 opens as a result of shifting sleeve 96 so flow can go around seated ball 80 as shown by arrow 100. Sleeve 102 can be deployed with a dropped ball 104 to reclose ports 91 as shown in FIG. 8. Thus in the embodiment of FIGS. 4-8 the release of the scrapers happens discretely from the opening of the ported sub. It should be noted that the ported sub of FIGS. 6-8 is described in greater detail in U.S. Pat. No. 7,954,555 whose description is fully incorporated herein as though fully set forth.

Those skilled in the art will appreciate that the method saves rig time by allowing the use of selectively deployable scrapers that are stout enough to deal with the rotation of a drill sting as more hole is made beyond an existing cased or lined hole. The scrapers can be released when the bit is pulled of the hole bottom enough to get the scrapers inside the existing casing. The string can then be rotated while pulling out of the hole with the scrapers and associated stabilizers operative to clean debris off the tubular and circulation flow through an opened ported sub acting to sweep away released debris for the trip up to the surface. The release of the scrapers can be done in a single movement of a sleeve responsive to fluid pressure to break retainers associated with the scrapers and open circulation ports. This can be accomplished with a single object such as a ball that lands on a seat on an annular piston to block its central passage. The shifting of the piston opens a bypass around the ball so that flow can continue to the now opened circulation ports. Some flow can go down to the bit and come back up to keep debris away from instruments and tools associated with the bit. Alternatively, by placement of the circulation ports above the ball seat and elimination of the bypass, all the flow can go for circulation to assist the scraping operation.

The release of the scrapers and the actuation of the circulation sub can be done in two steps with different size balls operating discrete piston sleeves for sequential operation of the scrapers followed by opening the circulation ports. As a further option another piston sleeve can respond to a second landed object to close the circulation ports, if necessary.

The ability to ream after drilling more hole saves the operator rig time and hence money. The associated apparatus in its variations allows simple actuation of the scrapers when properly positioned and effective scraping and debris removal through circulation through the opened circulation ports.

The above description is illustrative of the preferred embodiment and many modifications may be made by those skilled in the art without departing from the invention whose scope is to be determined from the literal and equivalent scope of the claims below:

We claim:

1. A single trip borehole drilling method for extending a borehole through an existing tubular, comprising:

running in together a drilling assembly on a string that further comprises a drill bit and at least one scraper and a ported sub;

retracting said scraper to the string and keeping at least one circulation port closed when drilling with said drill bit;

positioning said scraper in the existing tubular;

releasing said scraper and opening at least one port in said ported sub by delivering at least one object into the borehole and applying pressure with said object located on at least one seat on at least one moving sleeve;

moving said at least one sleeve with pressure applied to said at least one object when landed on said at least one seat;

opening a bypass around said at least one object when landed on said at least one seat as a result of said moving;

flowing fluid through said port while using said scraper to scrape the existing tubular as said drilling assembly is brought through the existing tubular;

circulating fluid through said string and out said port when operating said scraper; and delivering none of said circulating fluid to said drill bit.

2. The method of claim 1, comprising:

positioning said scraper in said existing tubular by raising said bit, then releasing said scraper.

3. The method of claim 2, comprising:

releasing said scraper with a breakable member.

4. The method of claim 3, comprising:

breaking said breakable member with movement of said at least one sleeve within a housing for said scraper.

5. The method of claim 4, comprising:

using a shear pin as said breakable member.

6. The method of claim 4, comprising:

delivering said at least one object to said at least one seat on said at least one sleeve to selectively block a passage through said at least one sleeve.

7. The method of claim 1, comprising:

opening said port with the same movement of said at least one sleeve for breaking said breakable member.

8. The method of claim 1, comprising:

initially locating said at least one seat on said at least one sleeve between said at least one port and said drill bit.

9. A single trip borehole drilling method for extending a borehole through an existing tubular, comprising:

running in together a drilling assembly on a string that further comprises a drill bit and at least one scraper and a ported sub;

retracting said scraper to the string and keeping at least one circulation port closed when drilling with said drill bit;

positioning said scraper in the existing tubular;

releasing said scraper with a breakable member and opening at least one port in said ported sub by delivering at least one object into the borehole and applying pressure with said object located on at least one seat on at least one moving sleeve;

flowing fluid through said port while using said scraper to scrape the existing tubular as said drilling assembly is brought through the existing tubular, wherein the step of moving said at least one sleeve further comprises a first sleeve and a second sleeve:

using the first sleeve to release said scraper and using the second sleeve to selectively open said at least one port;

releasing said at least one object from said at least one seat located on said first sleeve after moving said first sleeve.

10. The method of claim 9, comprising:

using a plurality of collet heads held together by being located in a reduced diameter as said at least one seat on said first sleeve;

shifting said collet heads to an adjacent larger housing diameter to allow said at least one object to pass.

11. The method of claim 9, comprising:

allowing said at least one object to land on said second sleeve when released by said collet heads;

providing as said at least one seat a plurality of seats with a first seat on a first sleeve and a second seat on said second sleeve;

opening said at least one port with pressure on said at least one object located on said second seat.

12. The method of claim 11, comprising:

providing a third sleeve having a third seat thereon;

providing as said at least one object a first and a second objects;

locating said second object on said third seat in said third sleeve to close said at least one port after opening said at least one port with said second sleeve.

* * * * *